United States Patent [19]

Syak

[11] 4,088,415

[45] May 9, 1978

[54] GLARE SCREEN BLADE

[75] Inventor: Charles W. Syak, Girard, Ohio

[73] Assignee: Syro Steel Company, Girard, Ohio

[21] Appl. No.: 829,525

[22] Filed: Aug. 31, 1977

[51] Int. Cl.[2] ..... E01F 15/00

[52] U.S. Cl. ..... 404/6; 404/10; 256/1

[58] Field of Search ..... 404/6, 9, 10, 1, 71; 256/1, 13.1; 40/125 H

[56] References Cited

U.S. PATENT DOCUMENTS

| | | | |
|---|---|---|---|
| 1,650,093 | 11/1927 | Rank | 404/9 X |
| 2,318,722 | 5/1943 | Smith | 404/9 X |
| 3,096,079 | 7/1963 | Winn | 404/6 X |
| 3,114,303 | 12/1963 | Oberbach | 404/6 X |
| 3,276,333 | 10/1966 | Blok | 404/1 |
| 3,349,674 | 10/1967 | Hutwelker | 404/1 |
| 3,380,428 | 4/1968 | Abrams | 404/10 X |
| 3,583,297 | 6/1971 | Udden | 404/71 |

*Primary Examiner*—Nile C. Byers
*Attorney, Agent, or Firm*—Webster B. Harpman

[57] ABSTRACT

A hollow, vertically standing blade having a width substantially greater than its thickness is provided with raised chevron-like configurations on its wider surfaces to deflect light directed thereagainst. A plurality of such blades mounted in spaced relation in a row on a support in the mediun strip of a highway block light from the headlights of vehicles traveling in one direction with respect to vehicles traveling in the opposite direction.

7 Claims, 7 Drawing Figures

GLARE SCREEN BLADE

BACKGROUND OF THE INVENTION (1) Field of the Invention

This invention relates to light blocking articles such as fences, posts and the like positioned in the center of a divided highway to block light from the headlights of the vehicle moving therealong.

(2) Description of the Prior Art

Prior structures of this type have employed light screens of varying configuration as may be seen in U.S. Pat. Nos. 3,004,145, 3,276,333, 3,349,674 and 3,583,297.

In the first of these patents an anti-blinding screen with built in lamp means is disclosed, the screen comprising a continuous length of a fence-like screen material having relatively thick components.

U.S. Pat. No. 3,276,333 discloses a road screen in which continuous interlocking sections of oppositely disposed vertically standing channel shapes form a fence-like barrier.

U.S. Pat. No. 3,349,674 shows a headlight shielding device, a plurality of which are positioned on supports, each of the devices comprising a blade formed as an extruded shape of aluminum, the shape has a central tubular section with two opposite arcuate sections extending outwardly from either side thereof to form sine curves.

U.S. Pat. No. 3,583,297 discloses an anti-dazzling screen formed of a series of transversely flat arch shaped members positioned in continuous rows.

SUMMARY OF THE INVENTION

The present invention forms the individual glare screen blades as hollow blow molded plastic articles, which are light in weight and inexpensive to construct and easy to handle and install and forms ribs on the outer wider surfaces of the blades preferably in chevron-like patterns so that the ribs will deflect light which would otherwise be reflected by the smooth polished surfaces of the blades themselves. The glare screen blades as disclosed herein thus have a dual function; that of blocking light from the headlights of vehicles on the opposite side of a row of the glare screen blades and forming a visual indication of their presence by including reflecting and non-reflecting areas thereof making the blades readily visible to indicate the sideward limits of the highway, etc.

DESCRIPTION OF THE PREFERRED EMBODIMENT

Figure 1:
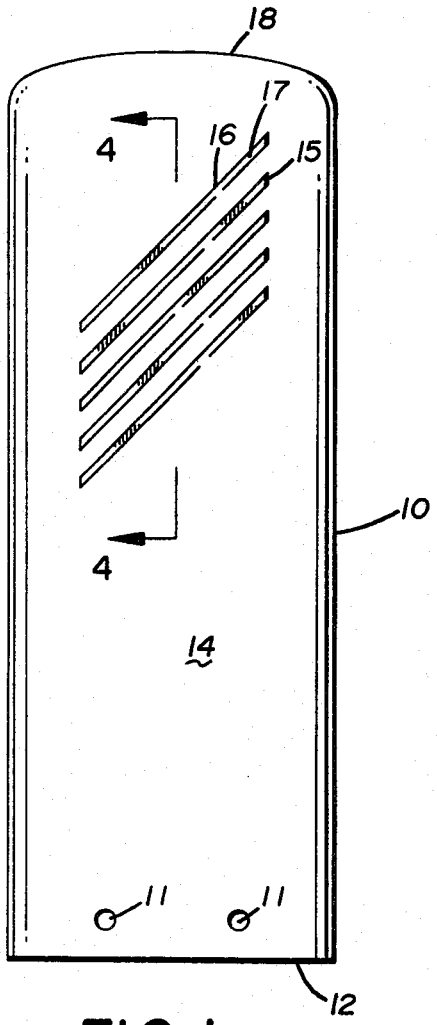
FIG. 1 is a front elevation of one of the glare screen blades.
Figure 2:
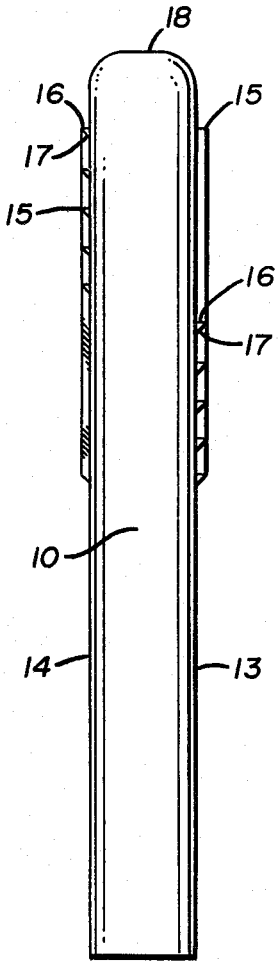
FIG. 2 is a side elevation thereof.
Figure 3:
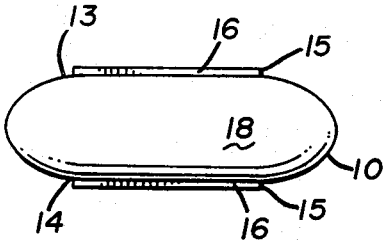
FIG. 3 is a top elevation thereof.
Figure 4:
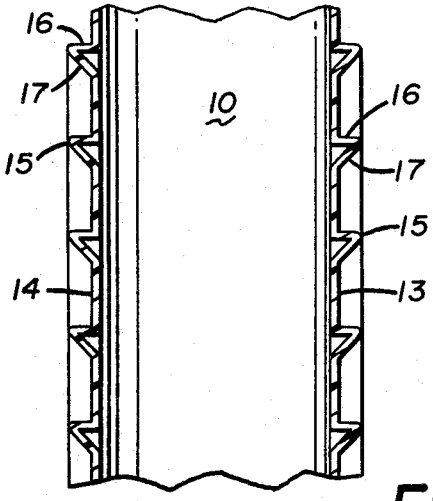
FIG. 4 is an enlarged cross sectional detail on line 4—4 of FIG. 1.

In its simplest form the glare screen blade of this invention takes the form of an enlongated vertically standing hollow blow molded body member 10, the front surface of which is indicated in FIG. 1 of the drawings. Apertures 11 adjacent a lower end 12 of the body member 10 enable fasteners to be positioned therethrough to secure the body member 10 to an upright mounting bracket engaged in the open end 12 of the body member 10 and positioned on or secured to a structure not shown, in the mediun strip of a highway. It will be understood that a plurality of the body members 10, each defining a glare screen blade, are positioned in spaced relation in a row along the mediun strip of a divided highway, the spacing being such that the headlights of vehicles moving on the highway in either direction are blocked from the vehicles traveling in the opposite direction. The back 13 of the body member 10 is a substantial duplicate of the front 14 and both the back 13 and front 14 have a plurality of diagonally positioned ribs 15, the upper surfaces 16 of which are formed at right angles to the vertical surface of the body member 10 and the lower surfaces 17 of which are formed at an angle thereto, for example a 45° angle and as best illustrated in FIGS. 2 and 4 of the drawings.

The upper end of the body member 10 is closed by a top portion 18 which is arcuate transversely thereof as best seen in FIG. 1 of the drawings. The front 14, back 13 and interconnecting side surfaces of the glare screen blade are smooth as formed by the polished surfaces in the mold in which they are formed and are capable of reflecting light to some degree. By forming the ribs 15 with the angular surfaces 17, the light that would otherwise be reflected from these areas is deflected so that the ribs appear as dark stripes on the surface of the glare screen body member 10. Additionally the ribs 15 add strength to the wider front and back surfaces of the body member 10.

Figure 5:
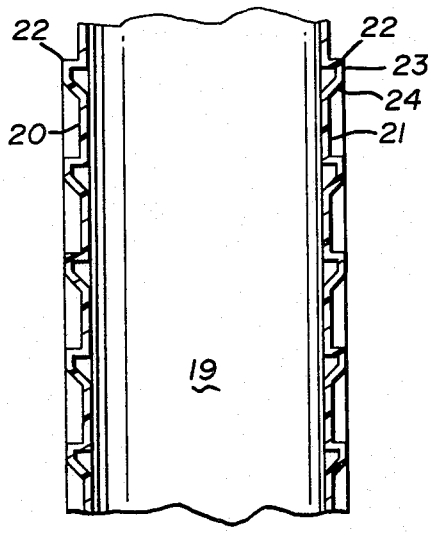
FIG. 5 is a cross sectional detail on an enlarged scale showing a modification in the configuration of the ribs on the surface of the glare screen blade.
Figure 6:
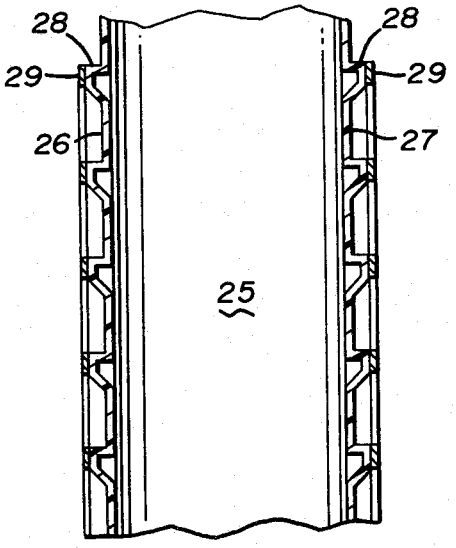
FIG. 6 is a cross sectional elevation in enlarged detail showing a further modification of the configuration of the ribs on the glare screen blade and FIG. 7 is a front elevation of a further modification of the glare screen blade in which stripes of light reflecting material, which may be fine glass beads in a suitable adhesive carrier, are present on the surfaces of the blade.
Figure 7:
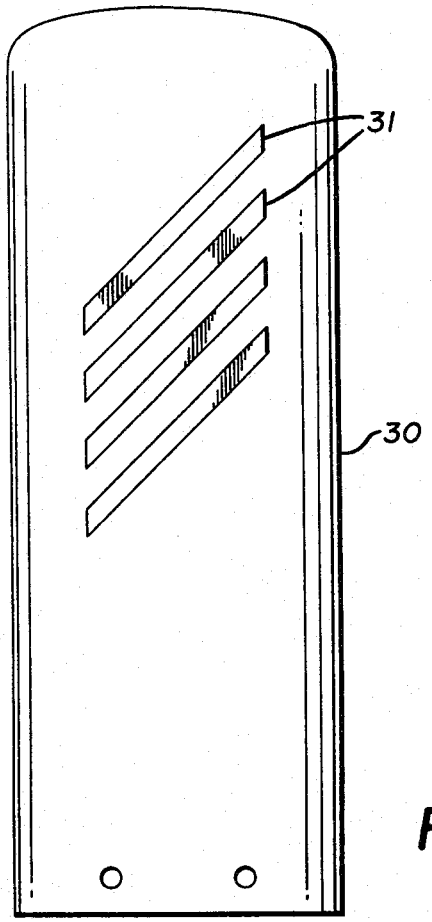

Those skilled in the art will observe that modifications of the invention hereinbefore disclosed are possible and three such modifications may be seen by referring to FIGS. 5, 6 and 7 of the drawings. In FIG. 5 of the drawings an enlarged cross sectional detail of a modified glare screen blade 19 may be seen and the front and the back sections thereof are indicated by the numerals 20 and 21 respectively. Both the front and back sections 20 and 21 have ribs 22 thereon and the configuration of the ribs 22 are modified by forming the same with offset vertical portions 23 which are parallel with the front and back surfaces 20 and 21 of the glare screen blade with the remainder of the ribs 22 being angularly disposed as at 24. The configuration results in narrower non-reflective portions of the ribs being present than in the preferred embodiment hereinbefore described.

In FIG. 6 of the drawings, a further modification of a glare screen blade may be seen in that a blade 25 with front and back surfaces 26 and 27 has a plurality of vertically spaced ribs 28 thereon, the outermost portions of each of the ribs 28 being provided with a light reflecting substance 29 such as glass beads in a suitable adhesive carrier. The modification of FIG. 6 will thus block the headlights as in the case of the blade of the preferred embodiment and at the same time provide a pattern of increased light reflective sections 29 to visually call attention to the presence of the blades which may then designate the limits of the highway and/or the presence of a mediun barrier or the like.

In FIG. 7 of the drawings, a still further modification may be seen in which a glare screen blade 30 is formed without the ribs of the preferred embodiment and the prior described modification and instead provide with strips 31 of either light absorbing material or light reflecting material so that a visual contrast is obtained which indicates the presence of the glare screen blade in addition to its function of blocking the headlights from a divided highway lane. The strips 31 may be porous black light absorbing material having adhesive characteristics or alternately light reflecting material such as glass beads in a white carrier with an adhesive quality.

It will thus be seen that a glare shield blade has been disclosed which has desirable dual functions in that a plurality of the blades will effectively block headlight glare from one lane of a divided highway to another and at the same time visually indicate its presence by a visual pattern on each of the blades.

Although but four embodiments of the present invention have been illustrated and described, it will be apparent to those skilled in the art that perhaps other changes and modifications may be made and without departing from the spirit of the invention and having thus described my invention what I claim is:

1. A glare shield blade, a plurality of which may be used to block headlight glare from one lane of a divided highway to the other, said blade comprising a vertically standing elongated member having a width greater than its thickness and similarly formed front and back surfaces, a plurality of ribs formed on at least one of said front and back surfaces, each of said ribs having at least one surface disposed at an angle to the surface on which it is formed and acting to deflect light at an angle to its source.

2. The glare shield blade set forth in claim 1 and wherein said ribs are integrally formed in said blade.

3. The glare screen blade set forth in claim 1 and wherein said blade is a hollow blow molded plastic article and the ribs are integrally formed therewith and the exterior surfaces thereof are smooth.

4. The glare screen blade set forth in claim 1 and wherein said ribs have a surface parallel with the surface of the blade on which they are formed.

5. The glare screen blade set forth in claim 1 wherein the ribs have a surface parallel with the surface of the blade on which they are formed and wherein a light reflecting substance is positioned on said parallel surface of each of said ribs.

6. The glare screen blade set forth in claim 1 and wherein the ribs have a surface parallel with the surface of the blade on which they are formed and wherein a light absorbing substance is positioned on said parallel surface of each of said ribs.

7. The glare screen blade set forth in claim 1 and wherein each of said ribs has a surface formed at an angle to the plane of the surface on which they are formed and a surface offset with respect thereto and parallel therewith.

* * * * *